US011313058B2

(12) United States Patent
Lin et al.

(10) Patent No.: US 11,313,058 B2
(45) Date of Patent: Apr. 26, 2022

(54) FLAT KNITTING MACHINE STRUCTURE WITH ADJUSTABLE GAP BETWEEN TWO KNOCK-OVER BITS

(71) Applicant: PAI LUNG MACHINERY MILL CO., LTD., New Taipei (TW)

(72) Inventors: Yu-Sheng Lin, New Taipei (TW); Chih-Chiang Lee, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 151 days.

(21) Appl. No.: 16/287,280

(22) Filed: Feb. 27, 2019

(65) Prior Publication Data

US 2020/0270781 A1 Aug. 27, 2020

(51) Int. Cl.

| | |
|---|---|
| ***D04B 15/36*** | (2006.01) |
| ***D04B 15/70*** | (2006.01) |
| ***D04B 15/96*** | (2006.01) |

(52) U.S. Cl.

CPC ..... *D04B 15/362* (2013.01); *D04B 15/70* (2013.01); *D04B 15/96* (2013.01)

(58) Field of Classification Search

CPC ..... D04B 15/06; D04B 15/24; D04B 15/362; D04B 15/367; D04B 15/70

See application file for complete search history.

(56) References Cited

U.S. PATENT DOCUMENTS

| | | | | | |
|---|---|---|---|---|---|
| 1,939,092 | A | * | 12/1933 | Emile | D04B 15/10 66/109 |
| 4,532,781 | A | * | 8/1985 | Buck | D04B 15/06 66/104 |
| 4,546,623 | A | * | 10/1985 | Kuhn | D04B 15/06 66/104 |
| 4,649,721 | A | * | 3/1987 | Goller | D04B 15/10 66/115 |
| 4,827,739 | A | * | 5/1989 | Goller | D04B 7/04 66/106 |
| 4,989,421 | A | * | 2/1991 | Schmidt | D04B 1/02 66/9 R |

(Continued)

FOREIGN PATENT DOCUMENTS

| | | | | |
|---|---|---|---|---|
| AT | 215060 B | * | 5/1961 | D04B 7/08 |
| CN | 102704180 A | | 10/2012 | |

(Continued)

*Primary Examiner* — Megan E Lynch

(74) *Attorney, Agent, or Firm* — Muncy, Geissler, Olds & Lowe, P.C.

(57) ABSTRACT

A flat knitting machine structure with an adjustable gap between two knock-over bits includes two needle beds and two cam systems. Each needle bed comprises a plurality of needles and a plurality of knock-over bits. Each needle comprises a butt. Each of the knock-over bits comprises a control butt. The two needle beds are disposed at interval so that the knock-over bits face each other to define a gap. The distance of the gap is equal to a space between two knock-over bits facing each other. Each cam system comprises a needle cam to provide the plurality of butts being placed and guide each needle to make a knitting stroke towards the gap, and a knock-over bit cam provides the control butts being placed. The knock-over bit cam is controlled to define a displacement stroke for driving the plurality of knock-over bits to change the size of the gap.

4 Claims, 8 Drawing Sheets

(56) References Cited

U.S. PATENT DOCUMENTS

| | | | | | |
|---|---|---|---|---|---|
| 5,231,854 | A * | 8/1993 | Schmid | D04B 15/06 | 66/106 |
| 5,355,699 | A * | 10/1994 | Inagaki | D04B 15/06 | 66/64 |
| 5,557,948 | A * | 9/1996 | Shima | D04B 7/26 | 66/106 |
| 6,014,874 | A * | 1/2000 | Shima | D04B 15/06 | 66/106 |
| 6,079,233 | A * | 6/2000 | Shima | D04B 15/06 | 66/106 |
| 7,980,100 | B2 * | 7/2011 | Lonati | D04B 15/06 | 66/106 |
| 2002/0000105 | A1 * | 1/2002 | Schmid | D04B 15/10 | 66/67 |
| 2004/0031292 | A1 * | 2/2004 | Morita | D04B 15/06 | 66/64 |
| 2008/0034805 | A1 * | 2/2008 | Miyamoto | D04B 15/90 | 66/104 |
| 2009/0044571 | A1 * | 2/2009 | Thompson | A41D 19/0096 | 66/174 |
| 2009/0314038 | A1 * | 12/2009 | Lonati | D04B 15/14 | 66/111 |
| 2010/0175428 | A1 * | 7/2010 | Lonati | D04B 15/06 | 66/13 |
| 2016/0265148 | A1 * | 9/2016 | Lee | D04B 1/126 | |

FOREIGN PATENT DOCUMENTS

| | | | | |
|---|---|---|---|---|
| CN | 102978823 | A | 3/2013 | |
| CN | 105220347 | A | 1/2016 | |
| EP | 0672769 | A1 * | 9/1995 | D04B 15/362 |
| EP | 3165651 | B1 * | 6/2018 | D04B 15/06 |

* cited by examiner

FLAT KNITTING MACHINE STRUCTURE WITH ADJUSTABLE GAP BETWEEN TWO KNOCK-OVER BITS

FIELD OF THE INVENTION

The present invention relates to a flat knitting machine structure, and in particular to a flat knitting machine structure which can adjust the size of a gap through knock-over bits.

BACKGROUND OF THE INVENTION

The existing knitting of three-dimensional fabric with adjustable thickness is generally realized by a warp knitting machine, as disclosed in patents of CN 102704180A, CN 102978823A and CN 105220347A.

However, the problem that the existing flat knitting machine cannot knit the foregoing mentioned fabric results from the flat knitting machine comprising fixed knock-over bits to define a gap therebetween, which is causing that the flat knitting machine can only knit the fabric with a single thickness.

SUMMARY OF THE INVENTION

The main purpose of the present invention is to solve an applied problem derived from a constant gap of the flat knitting machine.

To achieve the above purpose, the present invention provides a flat knitting machine structure with a gap to be adjustable, including two needle beds and two cam systems which are respectively disposed to face one of the needle beds. Each of the needle beds comprises a plurality of needles and a plurality of knock-over bits which are respectively disposed to correspond to each of the plurality of needles. Each of the plurality of needles comprises a butt. Each of the plurality of knock-over bits comprises a control butt disposed at a same side as each of the butts. The two needle beds are disposed at interval so that the plurality of knock-over bits face each other to define a gap, wherein the distance of the gap is equal to a space between two knock-over bits facing each other. Each of the plurality of needles defines a needle extending line. Each of the butts is respectively positioned on one of the needle extending lines. Each of the control butts is respectively positioned on one of needle extending lines in which one of the plurality of needles is correspondingly disposed. Each of the plurality of knock-over bits comprises an extending section provided with the control butt, a bending section connected with the extending section, and a loop hanging section connected with the bending section as well as paralleled to a front edge of one of the needles. Each of the cam systems comprises a needle cam to provide the butts being placed and guide each of the plurality of needles to make a knitting stroke towards the gap, and a knock-over bit cam provides the control butts being placed. The knock-over bit cam is controlled to define a displacement stroke for driving the plurality of knock-over bits to change the size of the gap.

In an embodiment, each of the plurality of knock-over bits comprises a wire mounting hole for loosening loop located on the loop hanging section, and at least one wire mounting hole for limiting position located on the extending section.

In an embodiment, each of the needle beds comprises a plurality of chutes respectively disposed on a needle bed base; and each of the plurality of knock-over bits comprises a bottom positioned at the loop hanging section for the knock-over bit cam sliding in the chute under the displacement stroke.

In an embodiment, each of the knock-over bit cams comprises a first guide section, a straight section connected with the first guide section, and a second guide section connected with the straight section, the first guide section and the second guide section are respectively tapered towards the straight section; and the size of the straight section is constant.

In an embodiment, each of the knock-over bit cams is respectively disposed at one side of one of the cam systems where faces the gap.

As previously disclosed in the present invention, compared with the prior art, the present invention has the following characteristics: the cam systems in the flat knitting machine structure of the present invention include the knock-over bit cams to move the knock-over bit according to knitting needs so that the gap of the flat knitting machine structure is adjustable to knit a three-dimensional fabric with different thicknesses.

DETAILED DESCRIPTION OF THE PREFERRED EMBODIMENTS

The details and technical contents of the present invention will be described below with reference to drawings.

Figure 4:
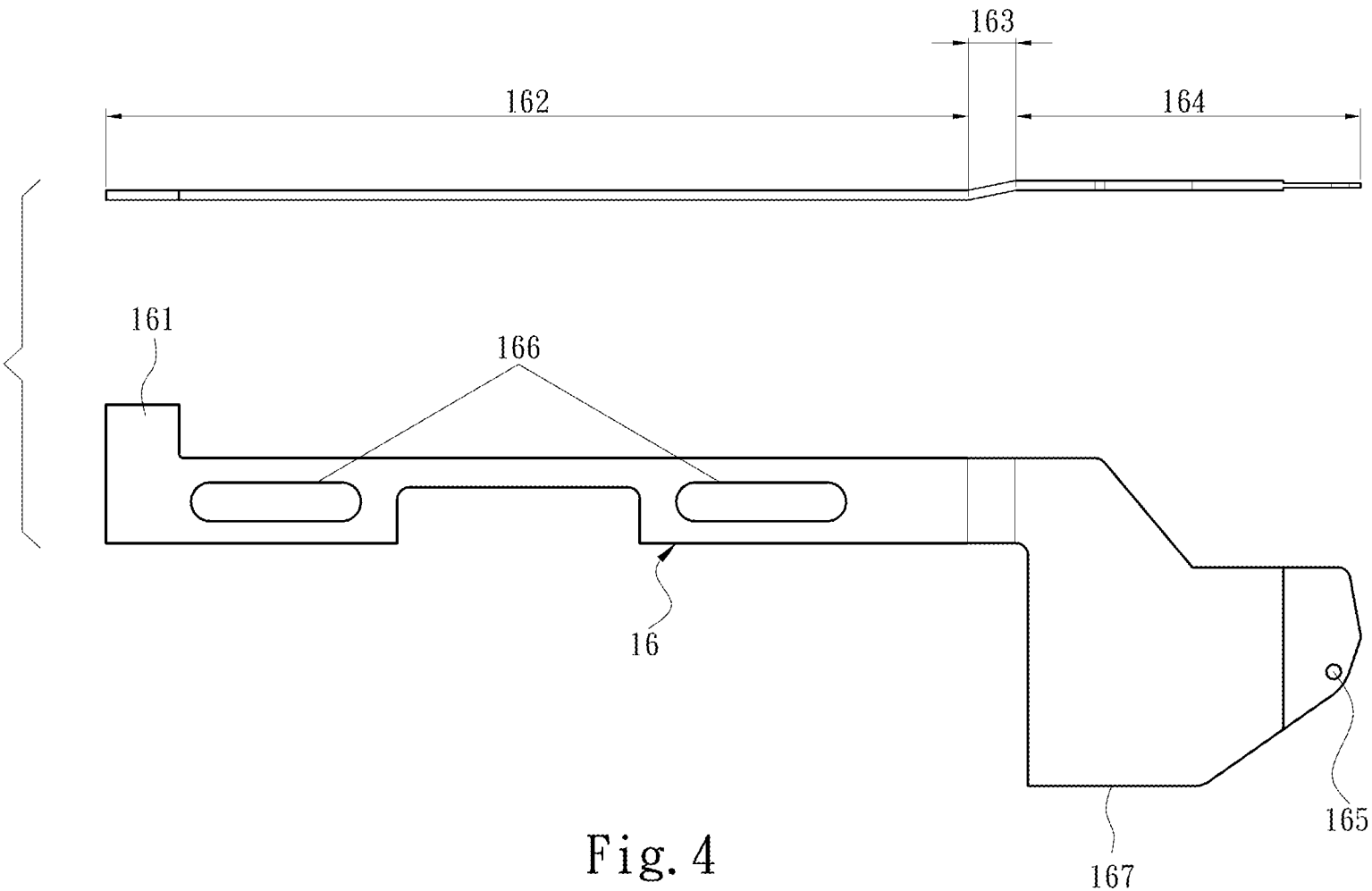
FIG. 4 is a structural schematic diagram of a knock-over bit in an embodiment of the present invention.
Figure 5:
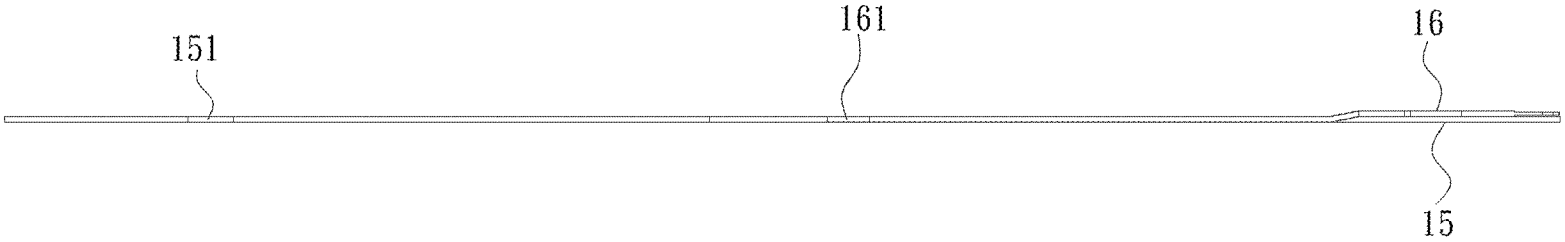
FIG. 5 is a schematic diagram of a structural relationship between a knock-over bit and a needle in an embodiment of the present invention.
Figure 6:
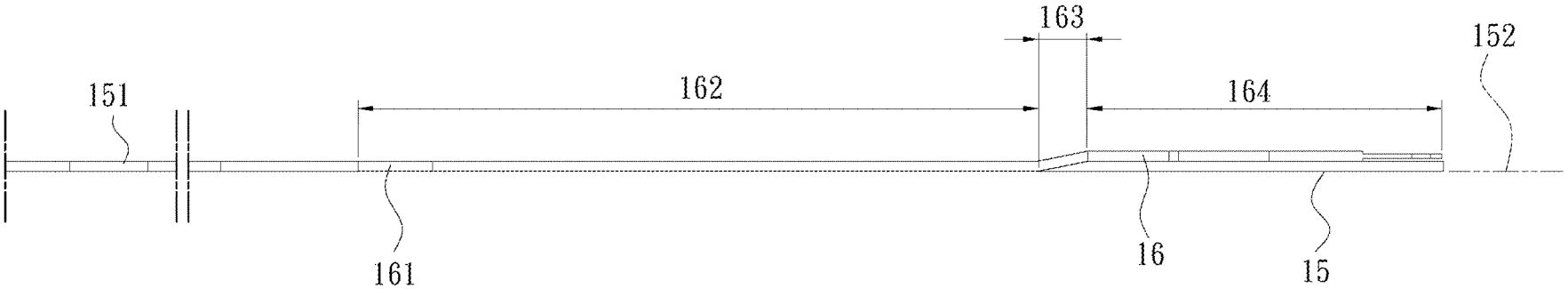
FIG. 6 is a partial enlarged diagram of a structural relationship between a knock-over bit and a needle in an embodiment of the present invention.

Referring to FIGS. 1, 2, 3, 4, 5, 6, 7, 8 and 9, the present invention provides a flat knitting machine structure 100 which is able to change the size of a gap 10 in accordance with knitting requirements during knitting process, so as to change the thickness of a three-dimensional fabric 90 (also called spacer fabric) in the knitting process. The flat knitting machine structure 100 includes two needle beds 11 and 12 and two cam systems 13(14) which are respectively disposed to face one of the needle beds 11(12). The two needle beds 11 and 12 mean a front needle bed and a rear needle bed in the current industry, wherein the two needle beds 11 and 12 are disposed in an inclined angle to correspond to each other. The two needle beds 11 and 12 are disposed at interval to form a space therebetween. Each of the needle beds 11(12) comprises a plurality of needles 15 and a plurality of knock-over bits 16 which are respectively disposed to correspond to each of the plurality of needles 15. The plurality of knock-over bits 16 of the present invention are not sinkers. Although the plurality of knock-over bits 16 are designed to be adjustable, however the plurality of knock-over bits 16 do not move when one of the plurality of corresponding needles 15 moves. Moreover, the gap 10 of the present invention is defined by the plurality of knock-over bits 16 of the two needle beds 11 and 12 that face each other. The distance of the gap 10 is equal to the space 101 (as shown in the figure) between two knock-over bits 16 which are facing each other. Referring to FIGS. 3, 4, 5 and 6, each of the plurality of needles 15 comprises a butt 151. Each of the plurality of knock-over bits 16 comprises a control butt 161 disposed at a same side as each of the butts 151. Further, each of the plurality of knock-over bits 16 is respectively overlapped on one of the plurality of corresponding needles 15, and the butt 151 is disposed at one side of the needle 15 opposing to a needle bed base 17. The control butt 161 is disposed at one side of the plurality of knock-over bits 16 opposing to the needle bed base 17. Referring to FIG. 6, each of the plurality of needles 15 may define a needle extending line 152. The butt 151 on the needle 15 is positioned on the needle extending line 152. The control butts 161 corresponding to the needle 15 on one of the plurality of knock-over bits 16 is also positioned on the needle extending line 152. Furthermore, in order to ensure that the control butt 161 and the butt 151 are positioned on the same needle extending line 152, the length of each of the plurality of knock-over bits 16 is shorter than the total length of the plurality of needles 15.

Figure 1:
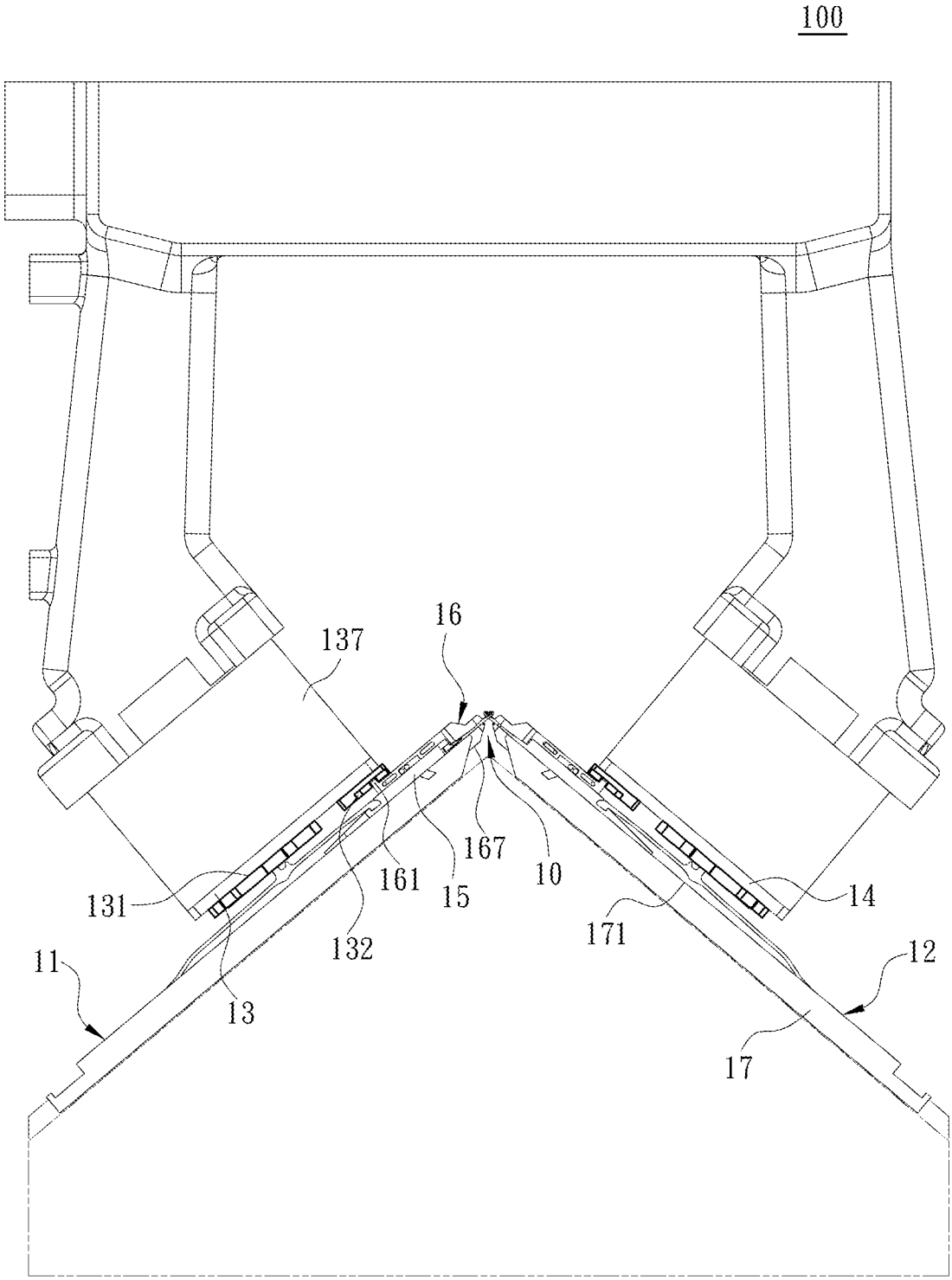
FIG. 1 is a structural schematic diagram of a flat knitting machine in an embodiment of the present invention.
Figure 2:
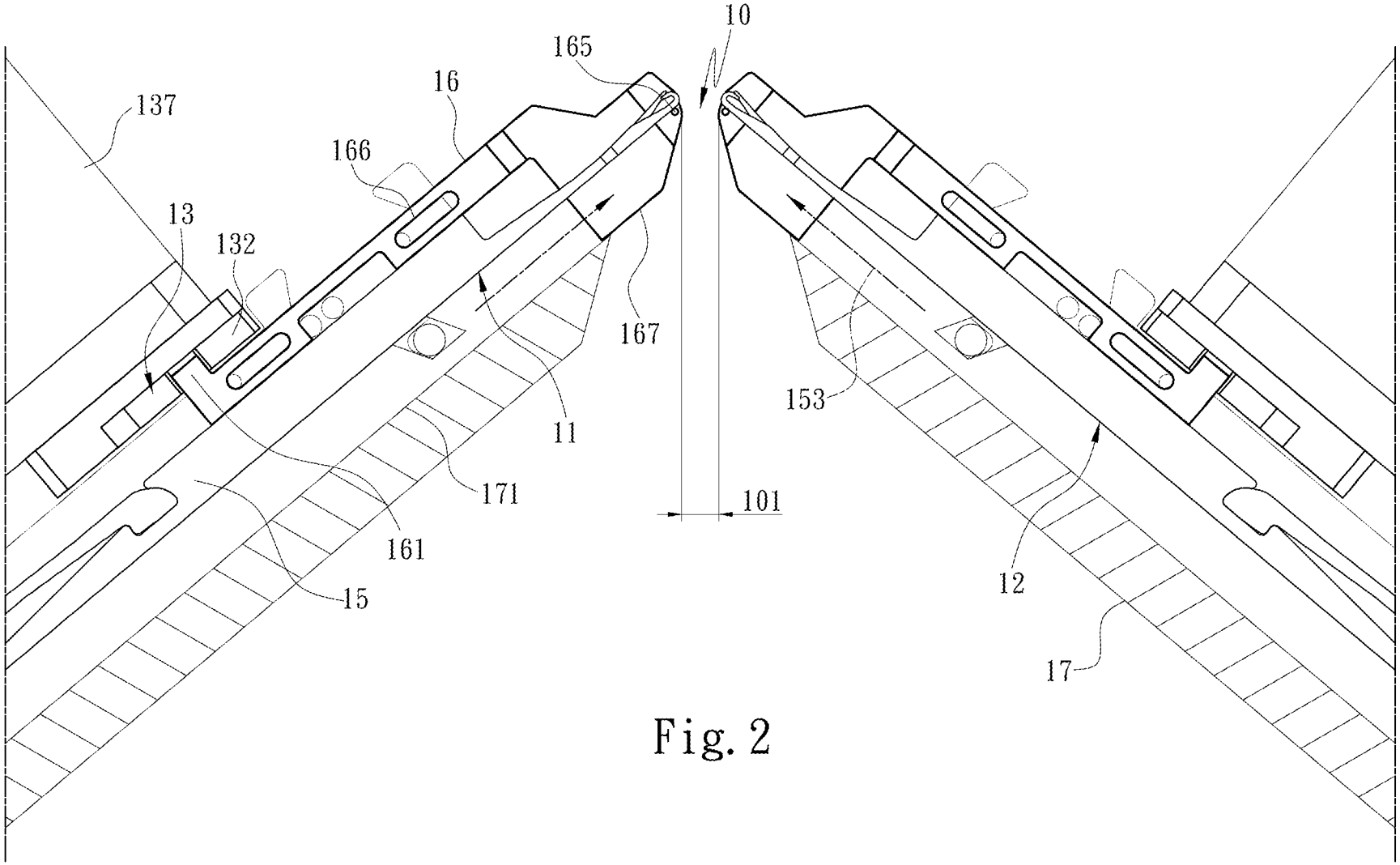
FIG. 2 is a structural schematic diagram of a needle bed part with a small gap in an embodiment of the present invention.

Referring to FIG. 4 and FIG. 6, in an embodiment, each of the plurality of knock-over bits 16 comprises an extending section 162 provided with the control butt 161, a bending section 163 connected with the extending section 162, and a loop hanging section 164 connected with the bending section 163 as well as paralleled to a front edge of one needle 15. Further, the extending section 162 is overlapped above the needle 15. The bending section 163 allows the loop hanging section 164 and the extending section 162 are positioned on different extending lines, and allows the loop hanging section 164 to parallel with the needle 15 and hang a loop when the needle 15 moves. Moreover, each of the plurality of knock-over bits 16 also comprises a wire mounting hole for loosening loop 165 located on the loop hanging section 164, and at least one wire mounting hole for limiting position 166 located on the extending section 162. Referring to FIGS. 5 and 6, in an embodiment, the plurality of knock-over bits 16 are implemented with two different thicknesses on the loop hanging section 164. Further, the thickness of the loop hanging section 164 of the knock-over bits 16 is able to be implemented with thicknesses smaller than the thickness of other parts of the knock-over bits 16, as shown in FIG. 6. Referring to FIG. 2 and FIG. 4, each of the needle beds 11 comprises a plurality of chutes 171 respectively formed on the needle bed base 17. Each of the plurality of knock-over bits 16 comprises a bottom 167 positioned at the loop hanging section 164 and disposed into the chute 171.

Figure 7:
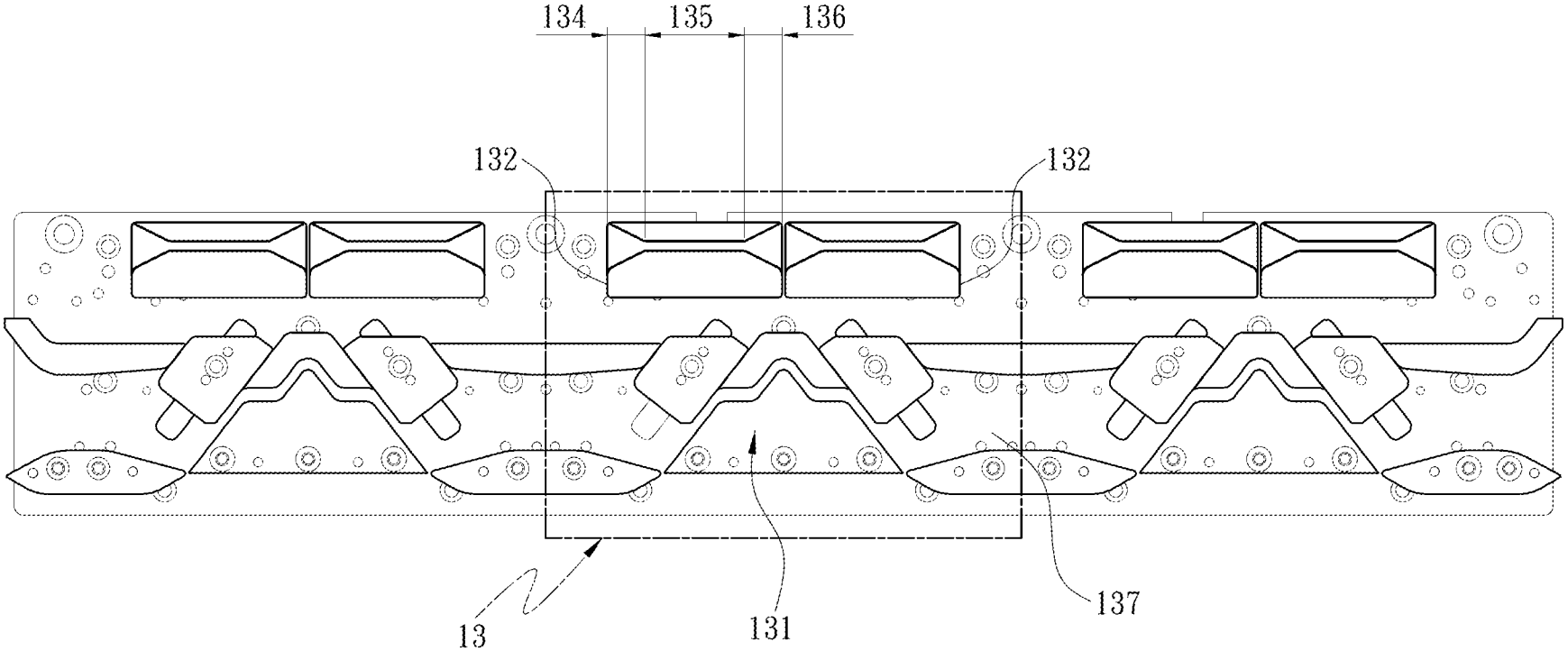
FIG. 7 is a structural schematic diagram of a cam system in an embodiment of the present invention.
Figure 8:
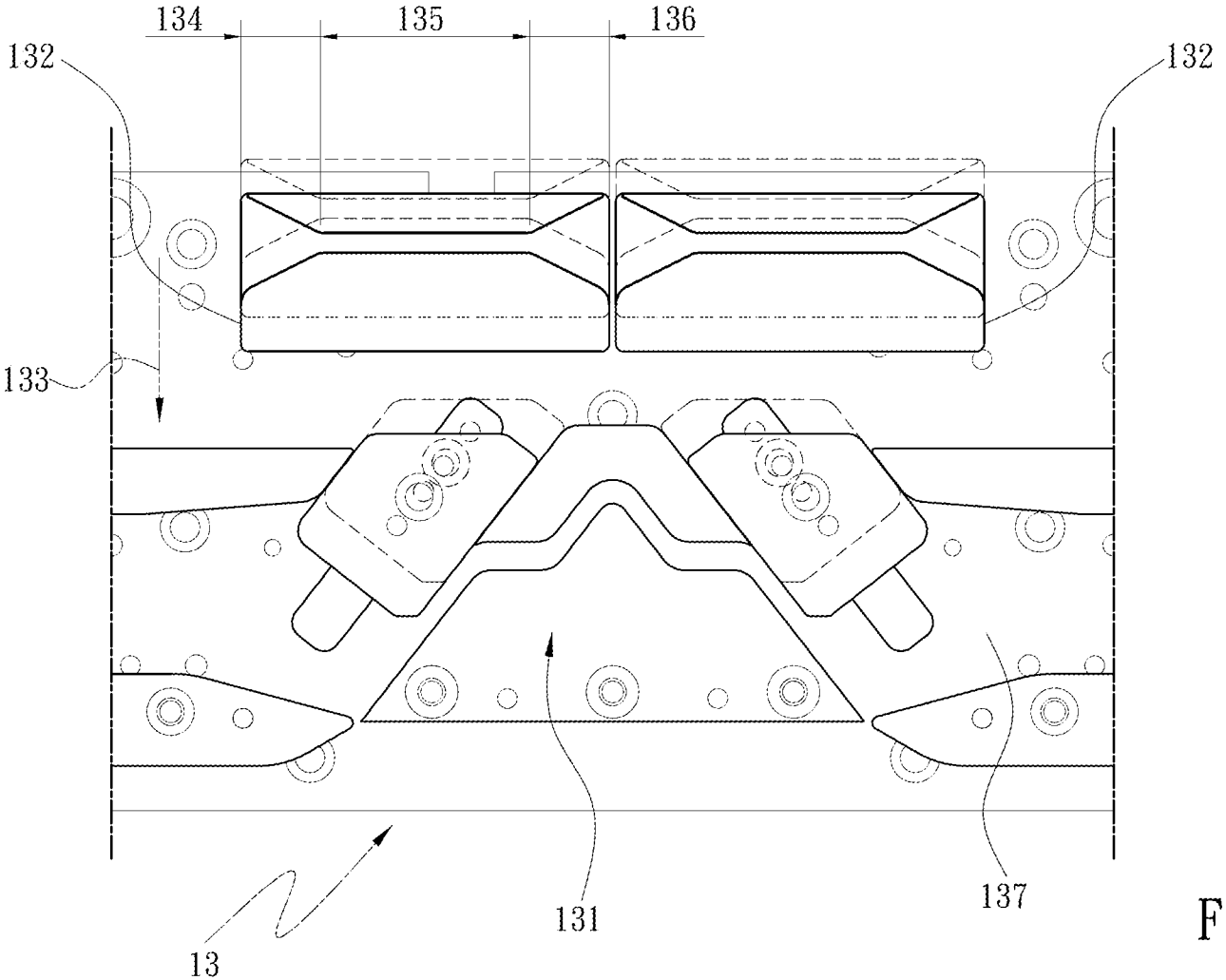
FIG. 8 is an implementation diagram of a cam system in an embodiment of the present invention.
Figure 9:
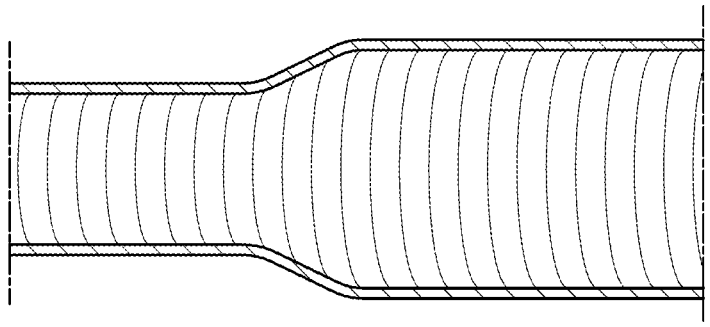
FIG. 9 is a structural schematic diagram of a three-dimensional fabric with adjustable thickness.

Referring to FIGS. 2, 7 and 8, in another aspect, each of the cam systems 13(14) is respectively disposed to face one of needle beds 11(12). Each of the cam systems 13(14) comprises a needle cam 131 to provide the butts 151 being placed, and a knock-over bit cam 132 provides the control butts 161 being placed. The needle cam 131 and the knock-over bit cam 132 may be formed by at least one cam unit. The needle cam 131 comprises a convex and a valley which are continuous so that the butts 151 disposed therein make a knitting stroke towards the gap 10 when each of the cam systems 13(14) is operated. Moreover, in an embodiment, the knock-over bit cam 132 comprises a first guide section 134, a straight section 135 connected with the first guide section 134, and a second guide section 136 connected with the straight section 135. The first guide section 134 and the second guide section 136 are respectively tapered towards the straight section 135, and the size of the straight section 135 is constant. Further, the first guide section 134 and the second guide section 136 are designed to be tapered in order to actually guide the control butts 161 after the knock-over bit cam 132 moves. Furthermore, each of the knock-over bit cams 132 is respectively disposed at one side of each of the cam system 13(14) where faces the gap 10.

Figure 3:
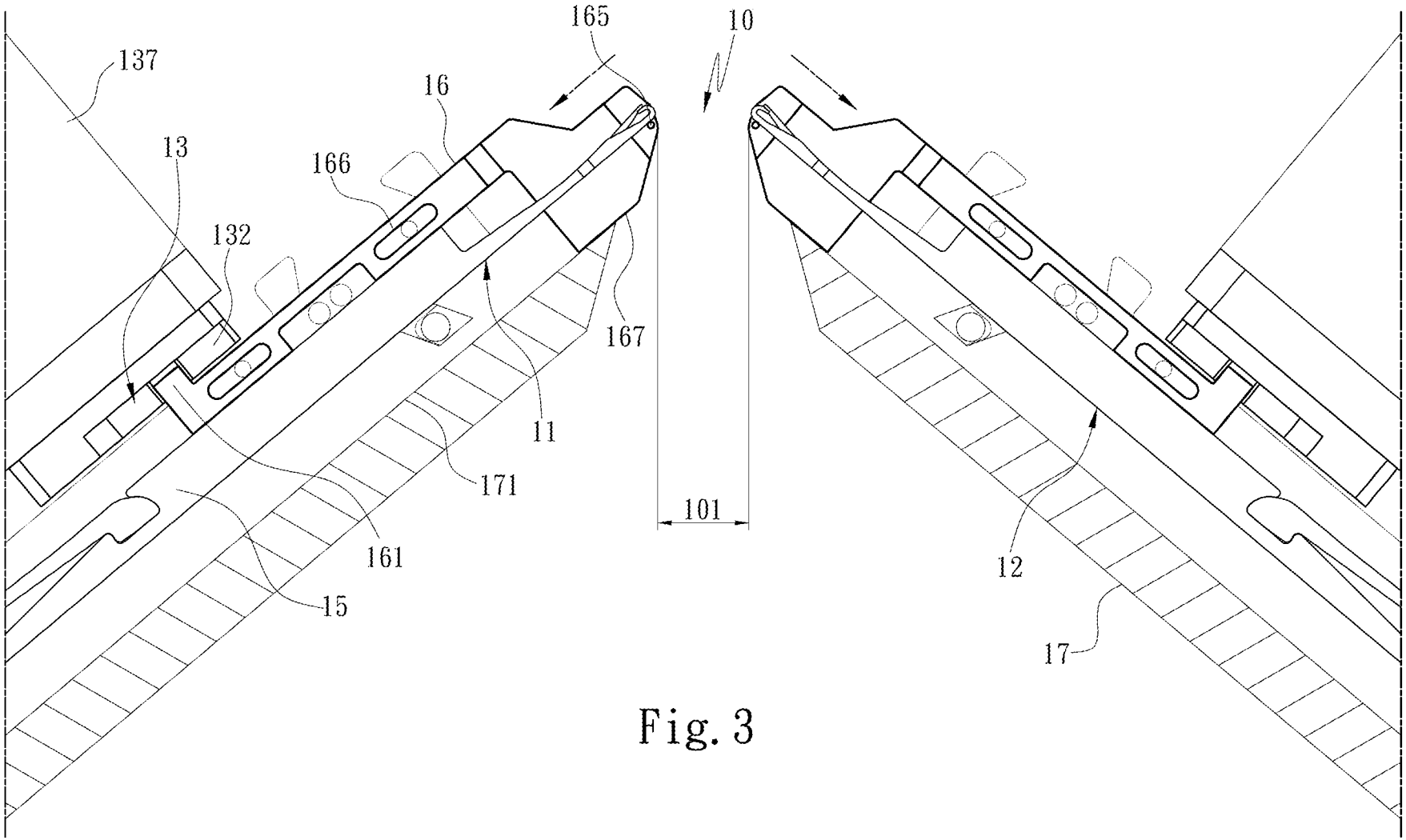
FIG. 3 is a structural schematic diagram of a needle bed part with a large gap in an embodiment of the present invention.

Based on the foregoing mentioned, the knock-over bit cam 132 of the present invention determines the position of each of the plurality of knock-over bits 16, so as to change the size of the gap 10. Unlike the needle cam 131, the knock-over bit cam 132 does not have the convex and the valley obviously. Most of guiding portions in the knock-over bit cam 132, which guides each of the plurality of knock-over bits 16, are straight. However, in the present invention, the knock-over bit cam 132 is controlled to define a displacement stroke 133. In the displacement stroke 133, the knock-over bit cam 132 makes one-dimensional motion relative to a cam base 137 and simultaneously drives each of the plurality of knock-over bits 16 to displace, so as to change the position of each of the plurality of knock-over bits 16. Thus, the size of the gap 10 is changed, and the foregoing-mentioned displacement of the knock-over bit cam 132 is shown in FIG. 2 and FIG. 3.

Based on this, each of the knock-over bit cams 132 of the present invention is also connected with a motion mechanism. The motion mechanism drives each of the knock-over bit cams 132 to make the displacement stroke 133 according to an accepted control signal. The generation of the control signal is set based on a programming. Thus, in the knitting process of the three-dimensional fabric 90, the thickness of the three-dimensional fabric 90 is changed, and the three-dimensional fabric 90 is even allowed to generate a structure with concave and convex outside the plane.

What is claimed is:

1. A flat knitting machine structure with an adjustable gap between two knock-over bits, comprising:

two needle beds, respectively comprise a plurality of needles and a plurality of knock-over bits disposed to correspond to each of the plurality of needles, wherein each of the plurality of needles comprises a butt; each of the plurality of knock-over bits comprises a control butt disposed at a same side as each of the butts; the two needle beds are disposed at interval so that the plurality of knock-over bits face each other to define a gap; a distance of the gap is equal to a space between two knock-over bits facing each other; each of the plurality of needles defines a needle extending line; each of the butts is respectively positioned on one of the needle extending lines; each of the control butts is respectively positioned on one of the needle extending lines of which one of the plurality of needles is correspondingly disposed; each of the plurality of knock-over bits comprises an extending section provided with the control butt, a bending section connected with the extending section and a loop hanging section connected with the bending section as well as paralleled to a front edge of one of the needles, wherein each of the plurality of knock-over bits further comprises a wire mounting hole for loosening loop located on the loop hanging section, wherein the at least one wire mounting hole for limiting position is an oblong hole; and at least one wire mounting hole for limiting position located on the extending section; and two cam systems, respectively disposed to face one of the needle beds, wherein each of the cam systems comprises a needle cam to provide the butts being placed and guide each of the plurality of needles to make a knitting stroke towards the gap, and a knock-over bit cam provides the control butts being placed; and the knock-over bit cam is controlled to define a displacement stroke for driving the plurality of knock-over bits to change a size of the gap, wherein the plurality of knock-over bits are driven to perform a linear stroke which is parallel to the needle extending line.

2. The flat knitting machine structure with an adjustable gap between two knock-over bits of claim 1, wherein each of the needle beds comprises a plurality of chutes respectively disposed on a needle bed base; and each of the plurality of knock-over bits comprises a bottom positioned at the loop hanging section for the knock-over bit cam sliding in the chute under the displacement stroke.

3. The flat knitting machine structure with an adjustable gap between two knock-over bits of claim 1, wherein each of the knock-over bit cams comprises a first guide section, a straight section connected with the first guide section, and a second guide section connected with the straight section, the first guide section and the second guide section are respectively tapered towards the straight section; and a size of the straight section is constant.

4. The flat knitting machine structure with an adjustable gap between two knock-over bits of claim 1, wherein each of the knock-over bit cams is respectively disposed at one side of one of the cam systems, and the side faces the gap.

* * * * *